US007104270B2

(12) United States Patent
Dong

(10) Patent No.: US 7,104,270 B2
(45) Date of Patent: Sep. 12, 2006

(54) UMBRELLA HAVING A SPRINKLER DEVICE

(75) Inventor: Peter Dong, Taipei (TW)

(73) Assignee: Test Rite International Company, Ltd., Taipei (TW)

( * ) Notice: Subject to any disclaimer, the term of this patent is extended or adjusted under 35 U.S.C. 154(b) by 477 days.

(21) Appl. No.: 10/663,686

(22) Filed: Sep. 17, 2003

(65) Prior Publication Data

US 2004/0129303 A1 Jul. 8, 2004

(30) Foreign Application Priority Data

Jan. 7, 2003 (TW) ..... 03200507 U

(51) Int. Cl.
*A45B 23/00* (2006.01)
*B05B 1/00* (2006.01)
*B05B 15/06* (2006.01)

(52) U.S. Cl. ..... 135/16; 239/273; 239/289

(58) Field of Classification Search ..... 135/16; 239/273, 289
See application file for complete search history.

(56) References Cited

U.S. PATENT DOCUMENTS 5,143,107 A * 9/1992 Kelley ..... 135/16
6,161,771 A * 12/2000 Henry ..... 239/17
6,682,000 B1 * 1/2004 Apple ..... 239/289
6,848,629 B1 * 2/2005 Palmer et al. ..... 239/17
6,886,759 B1 * 5/2005 Okronick et al. ..... 239/289
2002/0078985 A1 * 6/2002 Farr ..... 135/16

* cited by examiner

*Primary Examiner*—Robert Canfield
(74) *Attorney, Agent, or Firm*—Bacon & Thomas

(57) ABSTRACT

An umbrella having a sprinkler device comprises an umbrella body and a sprinkler device. The umbrella body comprises a plurality of upper spokes and lower spokes, an upper spoke holder, a lower spoke holder and a shaft portion. One end of each upper spoke and lower spoke are respectively engaged with the upper and lower spoke holder such that the upper and lower spokes are radially disposed respectively. The other end of each lower spoke supports the corresponding upper spoke. The sprinkler device comprises a multi-link nozzle, a main hose, a plurality of tubes and spouts. One end of the main hose connects with the primary nozzle of the multi-link nozzle. One end of each tube connects with its corresponding secondary nozzle of the multi-link nozzle, and the other end thereof connected with a spout. Water is channeled through the multi-link nozzle to each tube and sprayed by each spout.

9 Claims, 7 Drawing Sheets

UMBRELLA HAVING A SPRINKLER DEVICE

BACKGROUND OF THE INVENTION

1. Field of the Invention

The present invention relates to an umbrella having a sprinkler device, more particularly, an umbrella used outdoors capable of spraying misty water to achieve cooling effect as well as blocking the sun.

2. Description of the Related Art

An umbrella not only prevents raindrops from falling on human bodies, but it also blocks the sun so as to prevent human skin from being hurt by UV rays. General umbrellas for personal use has already been improved from manual open and close umbrellas to automatic open and close umbrellas, even two-section or three-section umbrella shaft portions are provided for decreasing volumes and increasing convenience for carrying such. Such innovation from manual to automatic can also be seen on large parasol used outdoors such as backyards or beaches, with extra function of adjusting the canopy of such large parasol according to the sunlit angle, so as to achieve the function of total block of the sun. Please refer to TW Patent No. 89200617, 89219612 and 90200881.

Parasols are large umbrellas not able to be carried at will, and can only be fixated at a base and used on beaches or backyards. Since parasols are for blocking the sun only, they are incapable of further providing the cooling function.

SUMMARY OF THE INVENTION

The object of the present invention is to provide an umbrella having a sprinkler device that sprays misty water for the cooling effect.

The umbrella achieving the foregoing function comprises an umbrella body and a sprinkler device, wherein the umbrella body comprises a plurality of upper spokes, a plurality of lower spokes, an upper spoke holder, a lower spoke holder and a shaft portion. One end of each upper spoke and lower spoke are respectively engaged with the upper spoke holder and the lower spoke holder such that the upper spokes as well as the lower spokes are radially disposed respectively. The other end of each lower spoke supports the corresponding upper spoke. The sprinkler device comprises a multi-link nozzle, a main hose, a least one tube and at least one spout. One end of the main hose connects with the primary nozzle of the multi-link nozzle, and one end of each tube connects with its corresponding secondary nozzle of the multi-link nozzle, with the other end thereof being connected with a spout. The multi-link nozzle is disposed in the upper spoke holder, the main hose is disposed inside the shaft portion, each tube is disposed in the upper spoke, and each spout is disposed on the upper spoke. Water supplied to the main hose is channeled by water pressure through the multi-link nozzle to each tube, and then sprayed by each spout for cooling effect.

The shaft portion is a single shaft with the main hose disposed therein being a single hose as well.

The shaft portion can further be formed by an upper shaft portion and a lower shaft portion, and the main hose disposed therein can also be formed by serially connecting an upper main hose and a lower main hose.

Each spout is disposed at the end portion of each corresponding upper spoke and/or the jointing portion of each corresponding upper spoke and the lower spoke.

Each spout is further disposed with an adjusting mechanism for adjusting the angle of the spout.

The inlet end of the main hose can directly connect with the water source (a faucet) or with an inlet nozzle disposed in-between.

BRIEF DESCRIPTION OF THE DRAWINGS

These and other features, aspects and advantages of the present invention will become better understood with regard to the following description, appended claims and accompanying drawings that are provided only for further elaboration without limiting or restricting the present invention, where:

DETAILED DESCRIPTION OF THE PREFERRED EMBODIMENT

The following is a detailed description of the best presently known modes of carrying out the inventions. This description is not to be taken in a limiting sense, but is made merely for the purpose of illustrating the general principles of the inventions.

The umbrella having a sprinkler device 10 of the present invention comprises an umbrella body 20 and a sprinkler device 50, which are to be elaborated in accordance with FIGS. 1 to 4 as follows.

Figure 1:
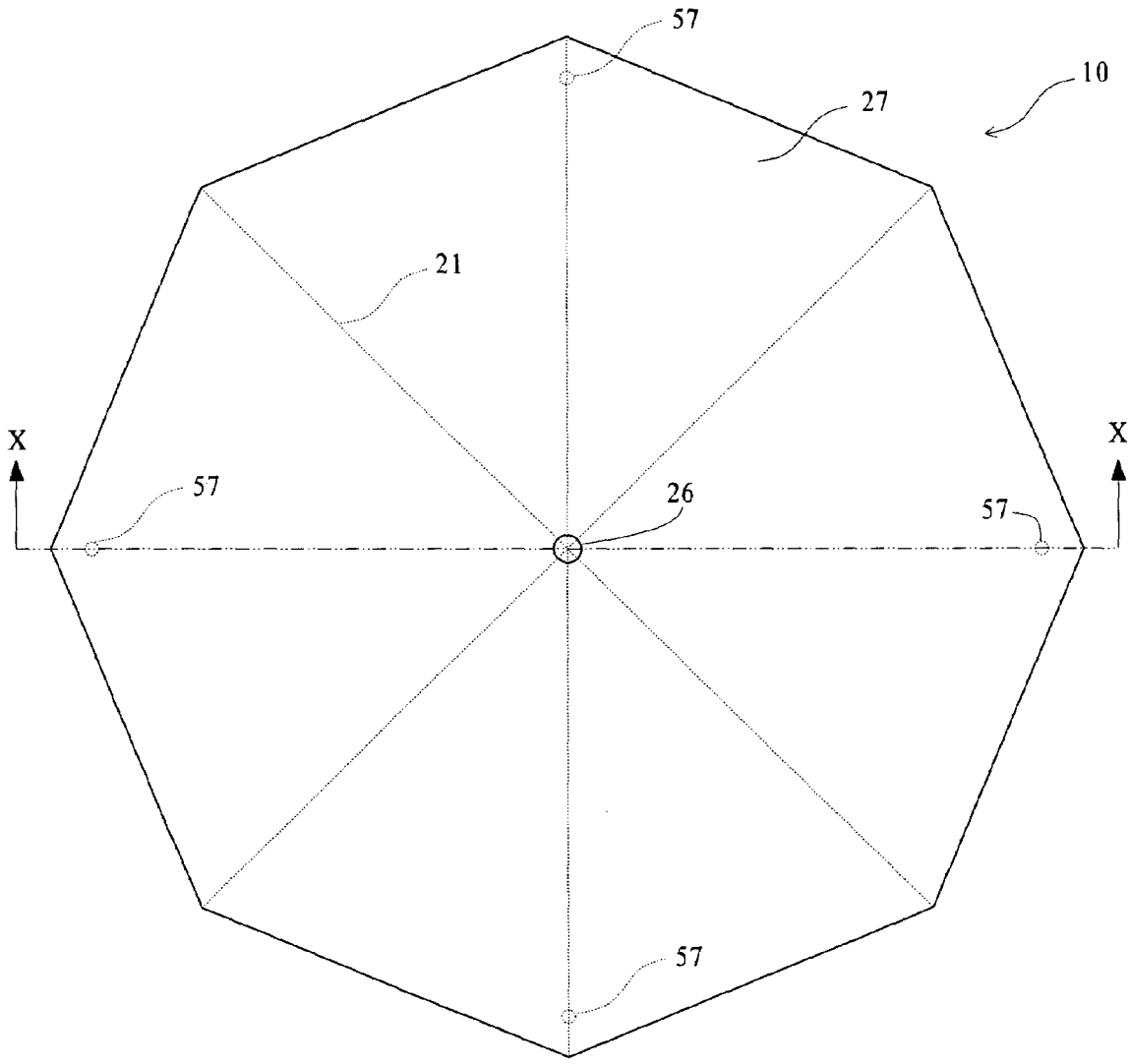
FIG. 1 shows a top plan structural view of an umbrella having a sprinkler device of the present invention.
Figure 2:
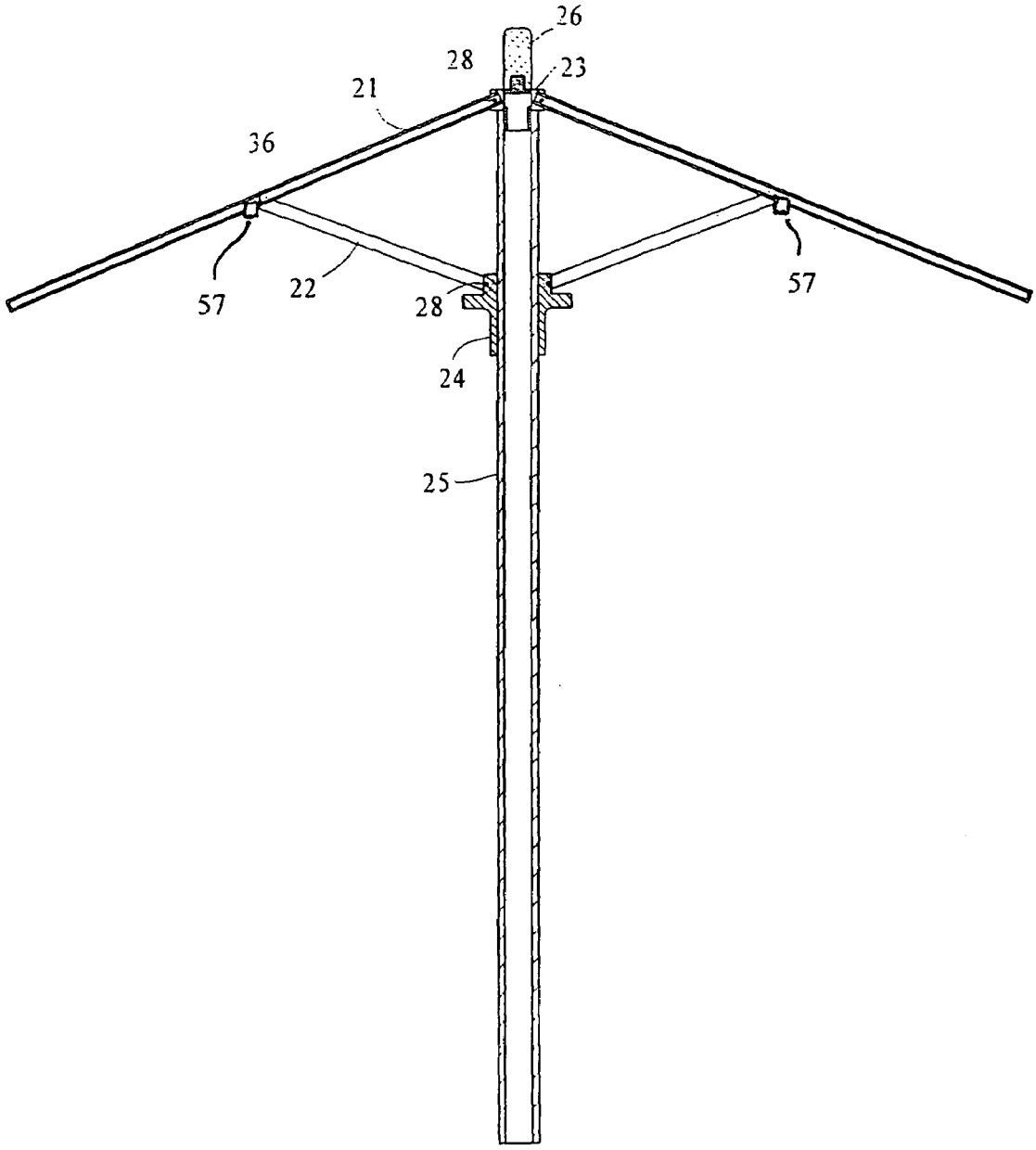
FIG. 2 shows a sectional structural schematic diagram of the line X—X in FIG. 1 manifesting the structure of the umbrella body and omitting the canopy and the sprinkler device.
Figure 4:
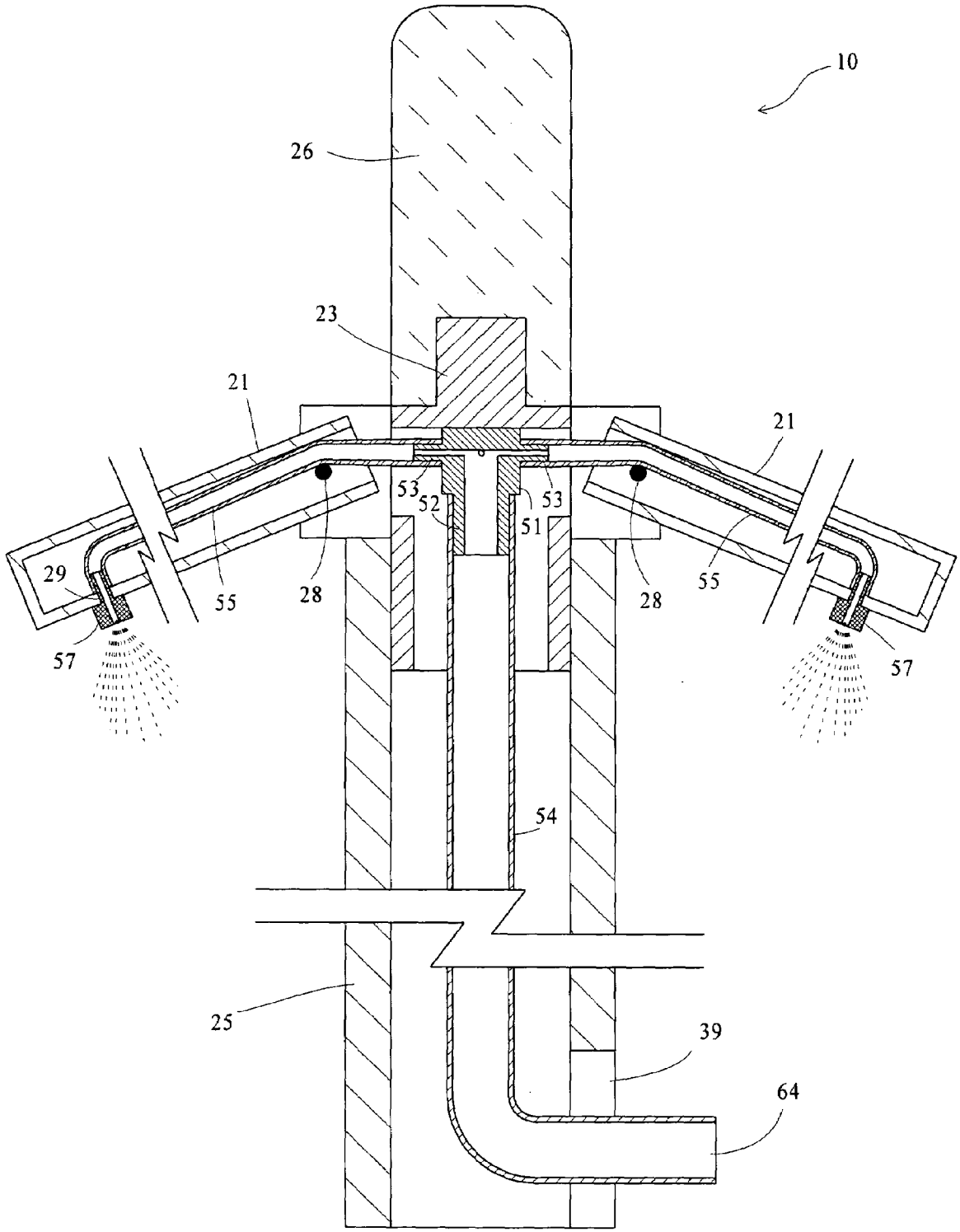
FIG. 4 shows a the sprinkler device in FIG. 3 being incorporated to the umbrella body in FIG. 2, forming a sectional structural view of the umbrella having a sprinkler device of the present invention.

As shown in FIG. 1 and FIG. 2 in accordance with FIG. 4, the umbrella body 20 comprises eight upper spokes 21, eight lower spokes 22, an upper spoke holder 23, a lower spoke holder 24 and a shaft portion 25, wherein one end of each upper spoke 21 is fastened to the upper spoke holder 23 via a steel wire 28, such that the upper spokes 21 are radially disposed outwardly with the upper spoke holder 23 being the axle thereof, whereas one end of each lower spoke 22 is fastened to the lower spoke holder 24 via a steel wire 28 also, such that the lower spokes 22 are radially disposed outwardly with the lower spoke holder 24 being the axle thereof. The other end of each lower spoke 22 is connected with the corresponding upper spoke 21 at a proper location thereof via a shaft rod 36. The upper spoke 23 is fixated on the top end of the shaft portion 25, and an umbrella tip 26 is disposed on top of the upper spoke holder 23, such that the center of the canopy 27 is fixatedly held by the umbrella tip 26 and the upper spoke holder 23.

The canopy 27 is fastened on top of each upper spoke 21 by conventional means. The lower spoke holder 24 sheaths on the shaft portion 25 such that the lower spoke holder 24 is movable and fixable to complete the opening and closing of the umbrella. Since the umbrella body 20 is of conventional umbrella, there is no need to elaborate as to the operation aspect of the umbrella body 20.

Figure 3:
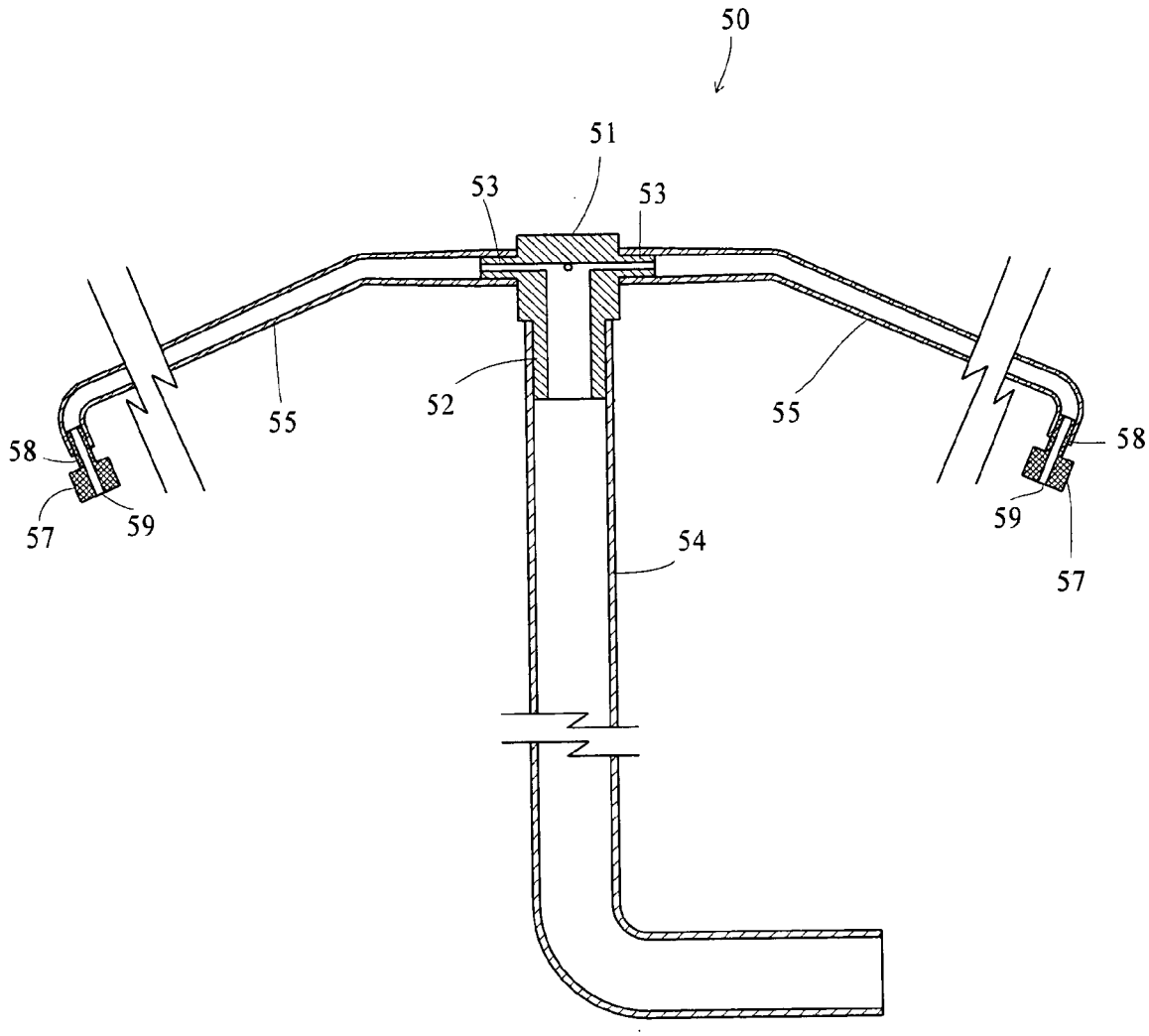
FIG. 3 shows a sectional structural view of the sprinkler device of the present invention.

As shown in FIG. 3, the sprinkler device comprises a multi-link nozzle 51 having a primary nozzle 52 and four secondary nozzles 53, a main hose 54, four tubes 55 and four spouts 57, wherein one end of the main hose 54 is connected with the primary nozzle 52 of the multi-link nozzle 51, one end of each tube 55 is connected with the corresponding secondary nozzle 53, whereas the other end of each tube 55 is connected with the jointing end 58 of the corresponding spout 57.

As shown in FIG. 4, the multi-link nozzle 51 is located in the upper spoke holder 23, and the main hose 54 is located in the shaft portion 25. Each tube 55 and each spout 57 are located in each alternate upper spoke 21. Please refer to FIG. 1, the spouts 57 are fixated at the apertures 29 of the upper spokes 21 with the spout holes 59 disposed downwardly. The inlet end 64 of the main hose 54 interposes through the opening 39 disposed at the lower portion of the shaft portion 25 and extends outwardly. With the inlet end 64 of the main hose 54 connecting to a water source such as a faucet, water flows in through the main hose 54 through the multi-link nozzle 51, and is channeled by the secondary nozzles 53 to each connecting tube 55, and eventually water is sprayed through the spout hole 59 of each spout 57 into misty water.

Figure 5:
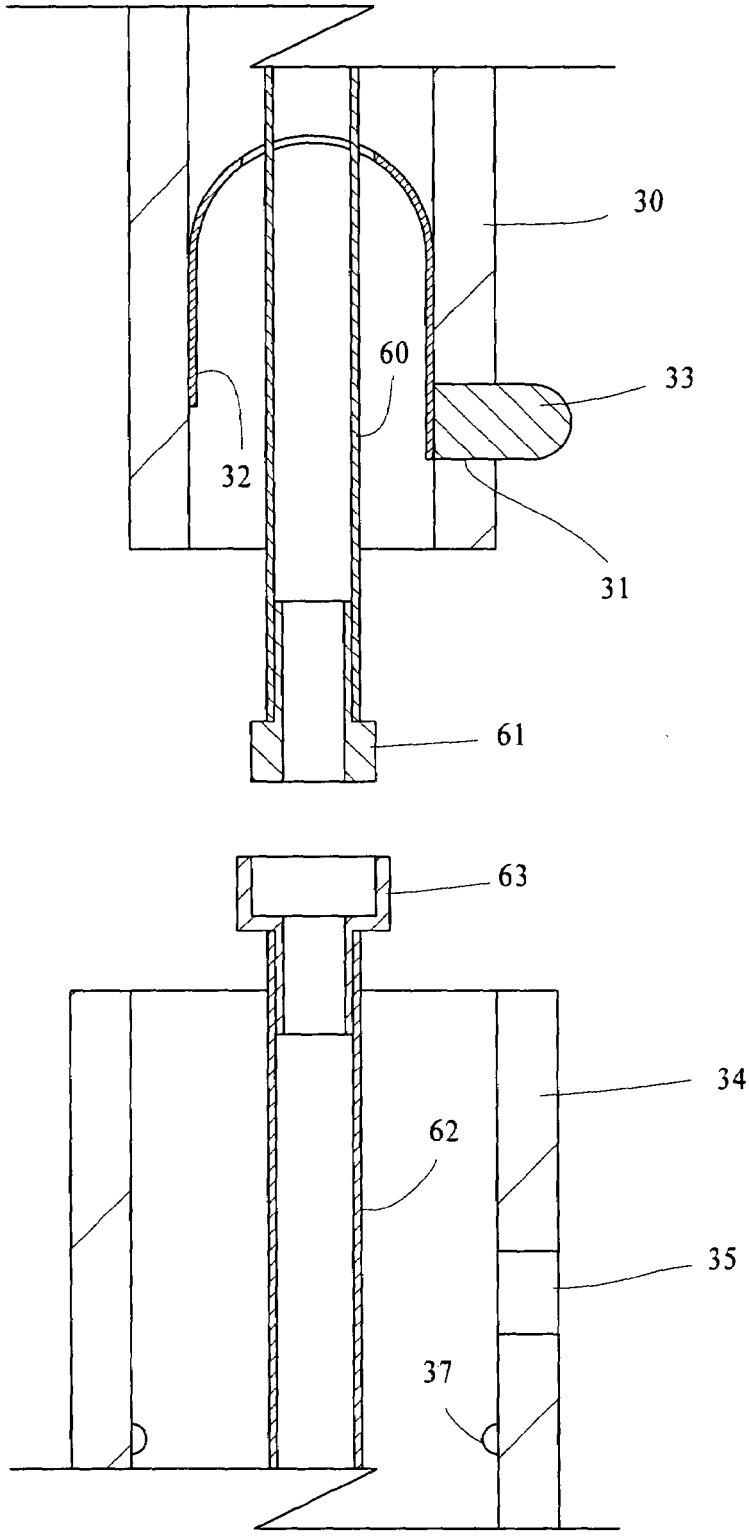
FIG. 5 shows an embodiment of the shaft portion of the umbrella body having an interposingly engaging structure.

The shaft portion 25 of the present invention may also be divided into an upper shaft portion 30 and a lower shaft portion 34 as shown in FIG. 5, so as to shorten the length of the shaft portion 25 during storage. The main hose 54, in accordance with the shaft portion 25, may also be divided into an upper main hose 61 and a lower main hose 62 respectively contained in the upper shaft portion 30 and the lower shaft portion 34. The upper main hose 60 is connected with an upper nozzle 61, whereas the lower main hose 62 is connected with a lower nozzle 63. A reversed U-shape elastic plate 32, disposed in the upper shaft portion 30, is mounted with an aperture for the upper main hose 60 to interpose through, and one end thereof is fixated on the inner wall of the upper shaft portion 30, whereas the other end thereof is fixatedly disposed with a stopper 33 that imposes through the aperture 31 of the upper shaft portion 30. The lower shaft portion 34 is disposed with an aperture 35 and a plurality of nodes formed thereunder by stamping. Since the outer diameter of the upper shaft portion 30 is smaller than the inner diameter of the lower shaft portion 34, the upper shaft portion 30 is interposingly engaged in the lower shaft portion 34 and fixated by nodes 37 while the stopper 33 is caused to move inwardly. As the elastic plate 32 resumes the elasticity, the stopper 33 resumes the original position and engages in the aperture 35 of the lower shaft portion 34 so as to achieve the goal of interposition and fixation. The upper nozzle 61 of the upper main hose 60 engages in the lower nozzle 63 of the lower main hose 62 before interposition, so as to enable the upper main hose 60 and the lower main hose 62 to connect and form a main hose 54.

Figure 6:
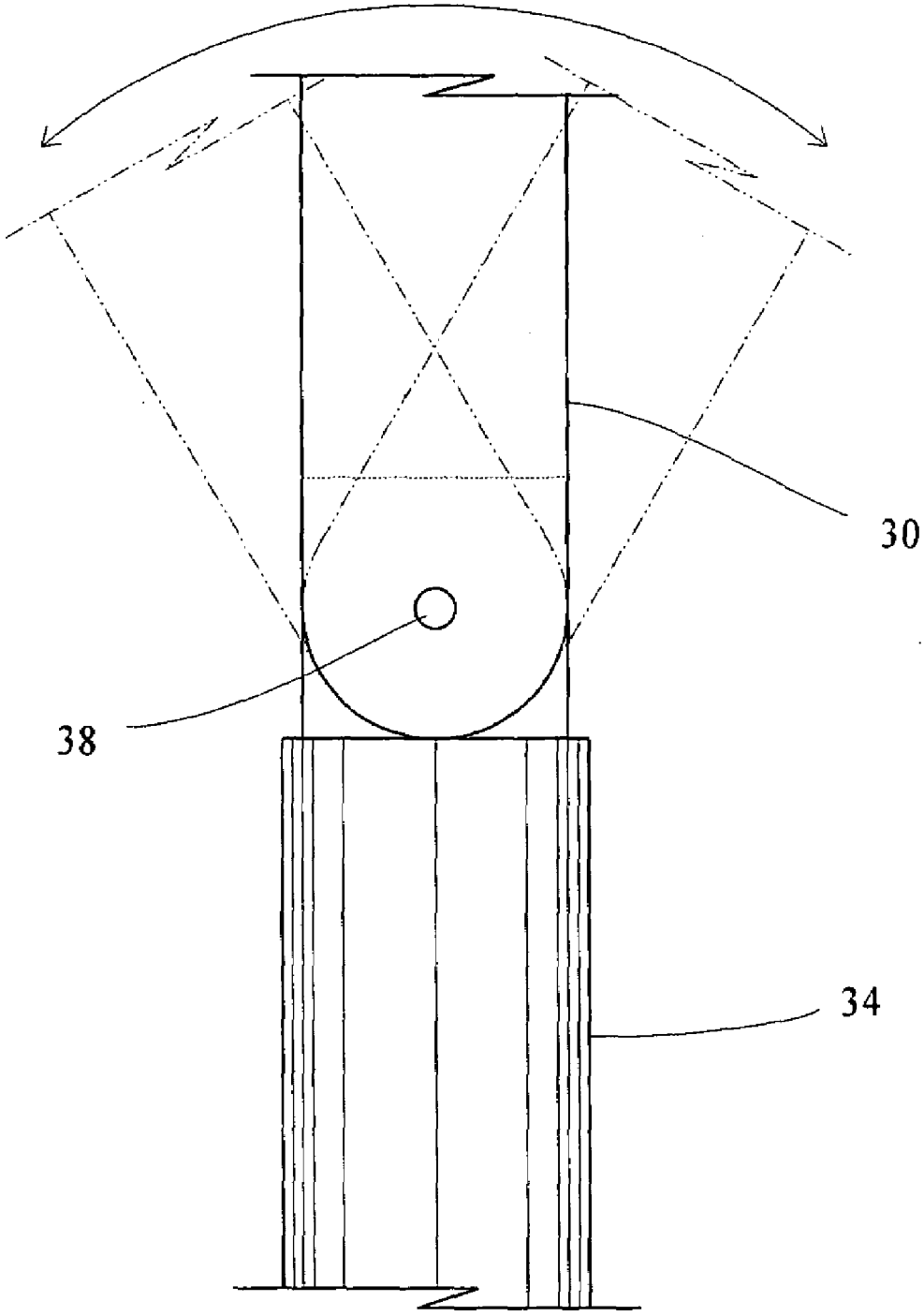
FIG. 6 shows an embodiment of the shaft portion of the umbrella body having a bendable structure.

Not only can the shaft portion 25 of the present invention be divided into an upper shaft portion 30 and a lower shaft portion 34 so as to connect both through interposition as shown in FIG. 5, but the shaft portion 25 can also form a joint structure as shown in FIG. 6, such that the upper shaft portion 30 can be biasly bent to adjust the angle of the canopy for effectively blocking the sun. As shown in FIG. 6, the upper shaft portion 30 and the lower shaft portion 34 are serially connected via the shaft rod 38 with the shaft rod 38 being the axis. The biased angles can be adjusted by a manual device (not shown in drawings), which is not elaborated herein for such structure is of conventional art.

Figure 7:
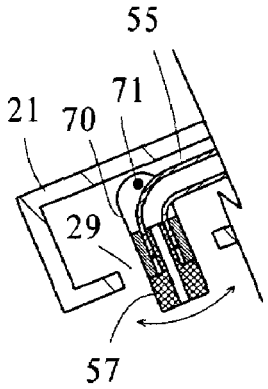
FIG. 7 shows a structural view of the spout of the sprinkler device of the present invention having the function of adjusting the spout angle.

FIG. 7 shows the spout 57 being fixated on an adjusting plate 70 which is fastened by an adjustable screw 71, such that by loosening or tightening the adjustable screw 71, the spout 57 can be adjusted to be toward left or right with the adjustable screw 71 as an axis. During this time, the aperture 29 is also enlarged such that the spout 57 may produce necessary displacement with the adjustable screw 71 as an axis.

Figure 8:
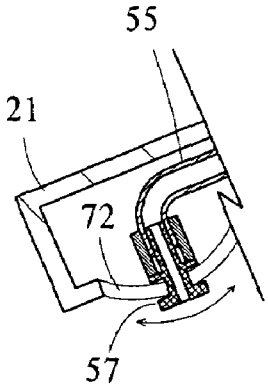
FIG. 8 shows another structural view of the spout of the sprinkler device of the present invention having the function of adjusting the spout angle.

FIG. 8 shows another embodiment of the spout 57 with adjustable sprinkling angles. In FIG. 8, the spout 57 is movably engaged and fixated in any position in a groove 72 such that the user may adjust the sprinkling angles. Apparently, various approaches can be implemented to adjust the sprinkling angles.

Figure 9:
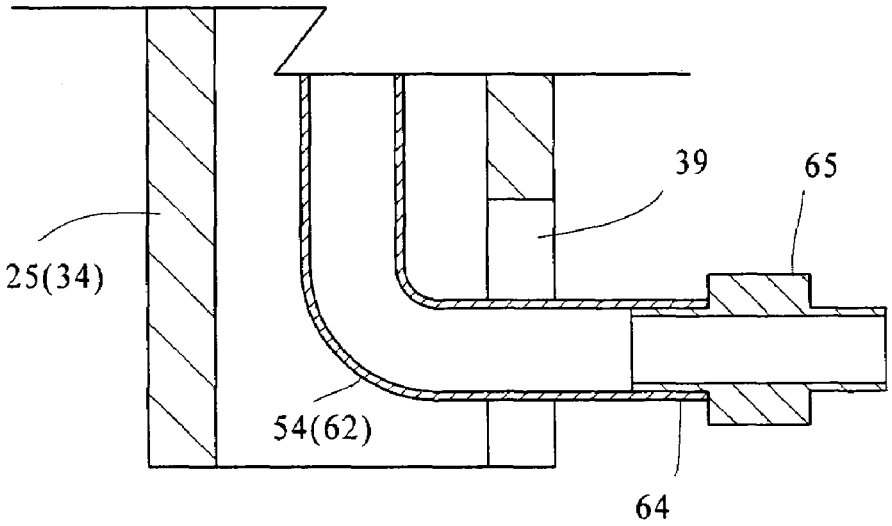
FIG. 9 shows a sectional structural view of the inlet end of the main hose of the sprinkler device of the present invention connecting with an inlet nozzle.

FIG. 9 further shows the inlet end 64 of the main hose 54 (or lower main hose 62) in the shaft portion 25 (or lower shaft portion 34) is disposed with an inlet nozzle 65, which can be a fast nozzle so as to swiftly connect with a faucet or other water outlets such as an outlet of a water tank wherein water is pumped by motors actuated by batteries. Such kind of apparatus comprising a water tank, batteries and motors may be utilized where no water pipes are provided.

Although the present invention has been described in considerable detail with reference to certain preferred embodiments thereof; those skilled in the art can easily understand that all kinds of alterations and changes can be made within the spirit and scope of the appended claims. For example, the quantities of each member are of reference only without being limited thereto. Spouts 57 can be disposed at the jointing portion between the upper shaft portion and the lower shaft portion, as shown in FIG. 2, and more than one spout can be disposed thereon. Since such spouts are of conventional art, there is no limitation on the actual structure thereof The angle adjustment of spouts can be achieved by various means. The structure of the shaft portion capable of being divided or bent can also be achieved by various means. Therefore, the spirit and scope of the appended claims should not be limited to the description of the preferred embodiments contained herein.

What is claimed is:

1. An umbrella having a sprinkler device, comprising:

an umbrella body comprising a plurality of upper spokes;

a plurality of lower spokes;

an upper spoke holder;

a lower spoke holder; and a shaft portion;

a sprinkler device comprising:

a multi-link nozzle;

a main hose;

at least one tube; and at least one spout;

wherein one end of each said upper spoke being engaged with said upper spoke holder such that said upper spokes being radially disposed respectively, one end of each said lower spoke being engaged with said lower spoke holder such that said lower spokes being radially disposed respectively, said lower spoke holder being movable and fixated on said shaft portion, the other end of each said lower spoke being supporting the corresponding said upper spoke, one end of said main hose of said sprinkler device being connected to a primary nozzle of said multi-link nozzle, one end of said tube being connected to a secondary nozzle of said multi-link nozzle, the other end of said tube being connected to said spout, said multi-link nozzle being located in said upper spoke holder, said main hose being located in said shaft portion, said tube being located in said upper spoke, and said spout being disposed at said upper spoke.

2. The umbrella having a sprinkler device as in claim 1, wherein said shaft portion is a single shaft.

3. The umbrella having a sprinkler device as in claim 1, wherein said main hose is a single hose.

4. The umbrella having a sprinkler device as in claim 1, wherein said shaft portion can further be formed by an upper shaft portion and a lower shaft portion, and said main hose disposed therein can also be formed by serially connecting an upper main hose and a lower main hose.

5. The umbrella having a sprinkler device as in claim 1, wherein each said spout is disposed at the end portion of each said corresponding upper spoke.

6. The umbrella having a sprinkler device as in claim 1, wherein each said spout is disposed at the jointing portion of each said corresponding upper spoke and said corresponding lower spoke.

7. The umbrella having a sprinkler device as in claim 1, wherein some of the at least one spout are disposed at the end portion of each said corresponding upper spoke and others of the at least one spout are disposed at the jointing portion of each said corresponding upper spoke and said corresponding lower spoke.

8. The umbrella having a sprinkler device as in claim 1, wherein each said spout is further disposed with an adjusting mechanism for adjusting the angle of said spout.

9. The umbrella having a sprinkler device as in claim 1, wherein said main hose is connected with an inlet nozzle.

* * * * *